US005263874A

United States Patent [19]

Miller

[11] Patent Number: 5,263,874

[45] Date of Patent: Nov. 23, 1993

[54] THERMALLY CONTROLLED BI-PIN LAMP SOCKET

[76] Inventor: Jack V. Miller, 700 N. Auburn Ave., Sierra Madre, Calif. 91024

[21] Appl. No.: 28,294

[22] Filed: Mar. 9, 1993

[51] Int. Cl.[5] ..... H01R 13/00

[52] U.S. Cl. ..... 439/487; 439/617; 362/294

[58] Field of Search ..... 313/51, 318; 362/294; 439/487, 361, 617, 682, 687

[56] References Cited

U.S. PATENT DOCUMENTS

| | | | |
|---|---|---|---|
| 3,402,383 | 9/1968 | Hilzen | 439/487 |
| 3,431,540 | 3/1969 | Kopelman et al. | 439/487 |
| 4,568,854 | 2/1986 | Westlund, Jr. et al. | 439/617 X |
| 4,841,422 | 6/1989 | Groh | 439/487 X |

*Primary Examiner*—Larry I. Schwartz
*Assistant Examiner*—Khiem Nguyen

[57] ABSTRACT

A thermally controlled bi-pin lamp socket includes a pair of female, electrically-conductive receptacles, laterally spaced apart in a parallel relationship in a common plane, each female receptacle is an elongated tube with an internal surface at a first end mechanically and electrically engageable with the pins of a bi-pin lamp. The second end of each receptacle has a means for connection to a source of electrical power. The receptacles are retained in a ceramic housing having a generally flat configuration. The housing has upper and lower walls having internal surfaces in contact with external surfaces of the female receptacles. Heat-conductive metal radiators are held against the external walls of the ceramic housing by screws with nuts and spring washers.

10 Claims, 1 Drawing Sheet

THERMALLY CONTROLLED BI-PIN LAMP SOCKET

BACKGROUND OF THE INVENTION

This invention applies to the field of bi-pin lamp sockets, and in particular, those lamp sockets for high-temperature, high current lamp, such as quartz-halogen lamps. Bi-pin halogen lamps normally operate at very high temperatures in order to maintain the halogen transfer cycle that keeps the filaments from evaporating and depositing on the quartz bulb. It is common for such lamps to be operated at the highest possible current to produce high color temperatures required for display fixtures, instruments and projectors. This results in high pin seal temperatures.

It is well known in the industry that the life of a halogen lamp is inversely proportional to the pin seal temperature. The hotter the seals, the shorter the tamp life. It is also well known that lamp socket failures are usually caused by the overheating. The lamp pins are heated by the filament and they transfer heat to the socket receptacles. The receptacles become annealed and lose contact with the lamp pins, creating resistance and arcing. The contact resistance and arcing cause both the socket and the lamp to be further heated. The cycle of increasing contact resistance continues until failure of socket or the lamp pin seals (or more often both) occurs.

There are bi-pin sockets currently available, in which generally cylindrical ceramic housings hold female receptacles. A ring of finned heat radiator material is frictionally engaged onto the exterior of the ceramic housing. The principal disadvantages of these prior art devices is that the pin receptacles are not in intimate thermal contact with the housings, and the housings are so thick between the receptacles and the radiator that they are relatively ineffective heat transfer paths for reducing lamp pin temperatures. Therefore, they are still subject to characteristic arcing failures.

The disadvantages of the prior art sockets are overcome by achieving the primary purposes of the present invention: to reduce lamp pin seal temperatures; to maintain good contact between the lamp pins and socket receptacles; and to prevent resistance build-up and contact arcing.

SUMMARY OF THE INVENTION

In order to provide, efficient heat transfer from lamp pins to the socket receptacles, the present invention uses tubular female receptacles having high contact areas and tight engagement with the lamp pins. In order to control the temperature of the socket receptacles, the receptacles are in intimate thermal contact with the interior surfaces of relatively thin walls of a ceramic housing which, in turn, are in thermal contact with large-area heat radiators.

The structure of the invention permits the lamp pin heat to be efficiently transferred to the socket receptacles, which transfer heat through ceramic housing walls to heat radiators. In practice, the lamp pin seals are cooler, resulting in longer lamp life. The female socket receptacles also operate cooler, eliminating annealing, contact resistance and arcing. As a result the lamp performs better, with less light fall-off due to pin contact resistance.

In operation, production models of halogen lamp projectors using lamp sockets according to the present invention has totally eliminated all the previously-encountered lamp pin and socket failures of prior art sockets. Further, the lamps used in the present invention sockets have consistently exhibited substantially longer lamp life.

DETAILED DESCRIPTION OF THE DRAWINGS

Figure 1:
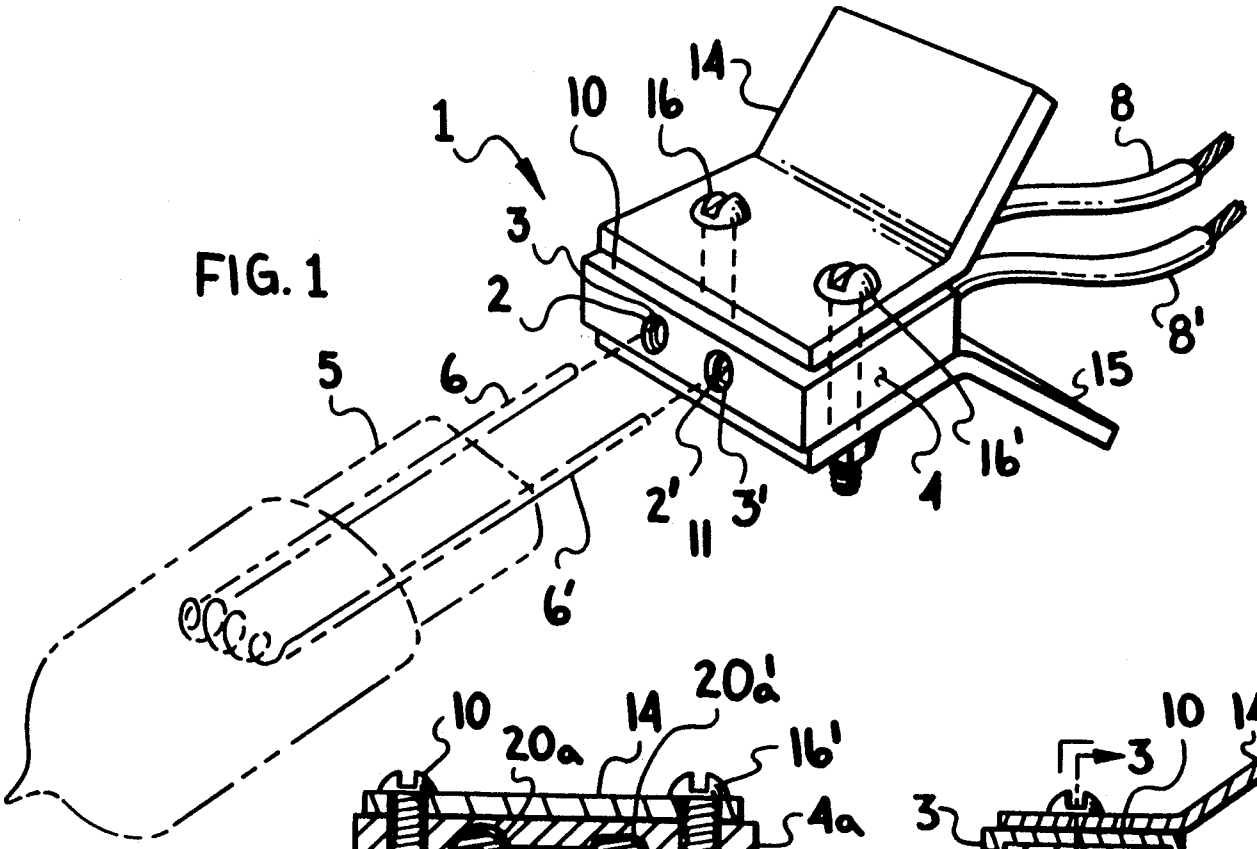
FIG. 1 is a perspective view of a thermally-controlled bi-pin lamp socket according to the present invention.

In FIG. 1 a socket 1 is shown in perspective, having a pair of female, electrically-conductive receptacles 2 and 2' laterally spaced apart in a parallel relationship in a common plane. The receptacles are disposed within and retained by apertures 3 and 3' in a generally flat, heat-resisting ceramic housing 4. A bi-pin lamp 5 (shown in phantom) has a pair of pins 6 and 6' that are mechanically and electrically engageable within receptacles 2 and 2', whereby the lamp may be connected by conductors 8 and 8' to a source of electrical power.

Figure 2:
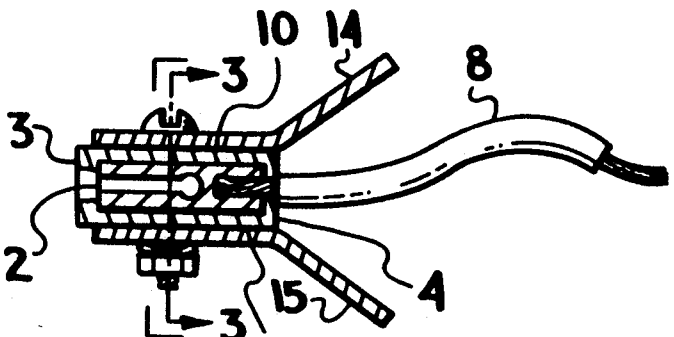
FIG. 2 is a longitudinal cross-sectional view of the socket of FIG. 1.

As shown in FIG. 1 and FIG. 2, ceramic housing 4 has a generally flat configuration including upper wall 10 and lower wall 11 having internal surfaces in contact with external surfaces of the female receptacle. The respective walls also have external surfaces generally parallel to the common plane of the female receptacles, which are in thermal contact with heatconductive metal radiators 14 and 15 in thermal contact with the respective external surface 10 of the upper wall and lower surface 11 of the lower wall of the ceramic housing. Heat conductive metal radiators 14 and 15 are held in thermal contact with the external surfaces 10 and 11, respectively, of the ceramic housing by one or more tension screws 16 and 16', nuts 17 and 17', with spring washers 18 and 18' urging the radiators 14 and 15 into intimate thermal contact with upper surface 10 and lower surface 11 of ceramic housing 4, even during dimensional changes due to the difference in thermal coefficient of expansion between the metal screws and the ceramic housing.

Figure 3:
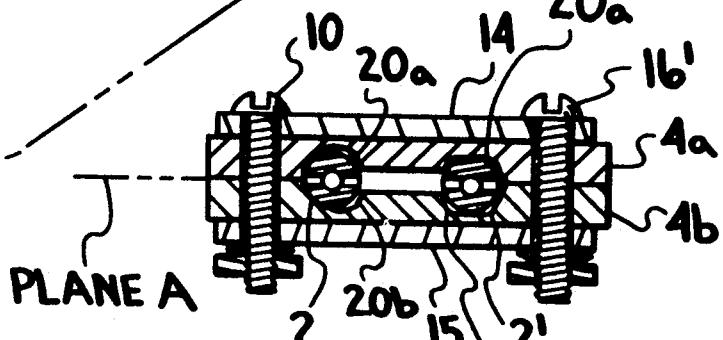
FIG. 3 is a transverse cross-sectional view of the socket of FIG. 2, taken along section line 3—3.

As shown in FIG. 3, the walls 10 and 11 of ceramic housing 4 have a minimum thickness consistent with structural strength to provide the greatest possible heat flow from the exterior surfaces of the female receptacles to the conductive metal radiators 10 and 11. Although housing 4 may be manufactured in one piece as seen in FIG. 1 and 2, a 2-piece housing comprising halves **4*a* and 4*b* are shown in FIG. 3. This permits more intimate thermal contact between receptacles 2 and 2' with housing halves 4*a* and 4*b*. Internal recesses 20*a* and 20*b* are in contact with receptacle 2 and internal recesses 20*a'* and 20*b'* are in contact with receptacle 2'. The recesses permit the parallel receptacles 2 and 2'** to move laterally in their common plane A to accommodate lamp pin-to-pin tolerances, while remaining in contact with the ceramic housing. The recesses provide additional radiation heat transfer of substantially the entire areas of the receptacles in addition to the conductive heat transfer by direct contact.

The configuration shown has proven very reliable in application having high lamp heat and current. The shapes illustrated for the ceramic housing and radiators are simple and provide a practical and low-cost socket. It is apparent that many other shapes are equally operable within the definition and concepts of the disclosure, as long as the heat-conduction paths are kept short, and the radiator areas relatively large.

I claim:

1. A thermally controlled bi-pin lamp socket comprising:

a pair of female, electrically-conductive receptacles, laterally spaced apart in a parallel relationship in a common plane, each of said female receptacles having an elongated tubular form including an external surface, an internal surface at a first end mechanically and electrically engageable with the pins of a bi-pin lamp, and a second end having means for connection to a source of electrical power;

a heat-resistant ceramic housing enclosing the female receptacles, said housing having an aperture therethrough coaxial with each of the female receptacles, said housing having a generally flat configuration including upper and lower walls with internal surfaces in contact with external surfaces of the female receptacles, said walls also having external surfaces generally parallel to the common plane of the female receptacles; and a pair of heat-conductive metal radiators in thermal contact with respective external surfaces of the upper and lower walls of the ceramic housing.

2. A thermally controlled bi-pin lamp socket according to claim 1 in which the heat conductive metal radiators are held in thermal contact with the external surfaces of the ceramic housing by one or more tension fasteners.

3. A thermally controlled bi-pin lamp socket according to claim 2 in which the tension fasteners are machine screws cooperating with matching nuts to urge the metal radiators against respective flat external surfaces of the ceramic housing.

4. A thermally controlled bi-pin lamp socket according to claim 3 in which the tension fasteners machine screws and matching nuts retain spring washers to urge the metal radiators against respective flat external surfaces of the ceramic housing during differential thermal expansion of the screws and the ceramic housing.

5. A thermally controlled bi-pin lamp socket according to claim 1 in which the surface area of heat-conductive metal radiators is substantially greater than the surface area of the ceramic housing.

6. A thermally controlled bi-pin lamp socket according to claim 1 in which the heat-conductive metal radiators are formed of black anodized aluminum.

7. A thermally controlled bi-pin lamp socket according to claim 5 in which the heat- conductive metal radiators are aluminum stampings.

8. A thermally controlled bi-pin lamp socket according to claim 1 in which the upper and lower walls of the ceramic housing have a thickness no greater than 0.060 inches separating the female receptacles from each of the heat-conductive metal radiators.

9. A thermally controlled bi-pin lamp socket according to claim 1 in which the heat-resistant ceramic housing enclosing the female receptacles comprises an upper half and lower half, each half including a pair or elongated recesses closely fitting the exterior of the respective female receptacles.

10. A thermally controlled bi-pin lamp socket according to claim 8 in which elongated recesses are laterally wider than the respective female receptacles, permitting lateral relative movement of the receptacles in their common plane.

* * * * *